US010253520B2

(12) United States Patent
Gerritsma

(10) Patent No.: US 10,253,520 B2
(45) Date of Patent: Apr. 9, 2019

(54) METHOD OF MANUFACTURING A FLEXIBLE FLAG ROD

(71) Applicant: Nickol Dulcey Gerritsma, Visalia, CA (US)

(72) Inventor: Nickol Dulcey Gerritsma, Visalia, CA (US)

( * ) Notice: Subject to any disclaimer, the term of this patent is extended or adjusted under 35 U.S.C. 154(b) by 150 days.

(21) Appl. No.: 15/465,058

(22) Filed: Mar. 21, 2017

(65) Prior Publication Data

US 2017/0270838 A1 Sep. 21, 2017

Related U.S. Application Data

(60) Provisional application No. 62/311,017, filed on Mar. 21, 2016.

(51) Int. Cl.
*E04H 12/32* (2006.01)

(52) U.S. Cl.
CPC ..... *E04H 12/32* (2013.01)

(58) Field of Classification Search
CPC ..... G09F 17/00; Y10T 29/49826; F16C 1/00; F16C 1/06; F16C 1/26; F16C 1/262
USPC ..... 29/428
See application file for complete search history.

(56) References Cited

FOREIGN PATENT DOCUMENTS

WO WO 2010054412 A2 * 5/2010 ..... G09F 7/22

* cited by examiner

*Primary Examiner* — David P Bryant
*Assistant Examiner* — Christine Bersabal

(57) ABSTRACT

A method of manufacturing a flexible rod requires a flexible rod, a first endcap, a second endcap, a first tab, a second tab, and a folded binding. The method preferably includes a sheet. The method begins by terminally fixing both the first endcap and the second endcap onto the flexible rod. The first tab is affixed to the first endcap and a first exposed section of the flexible rod. The second tab is affixed to the second endcap and a second exposed section of the flexible rod. The flexible rod is positioned within the folded binding and along a middle fold-line of the folded binding. The first tab and the second tab are oriented away from the middle fold of the folded binding. A first seam is sewn through the folded binding along the flexible rod. A second seam is sewn through the sheet and the folded binding.

11 Claims, 9 Drawing Sheets

METHOD OF MANUFACTURING A FLEXIBLE FLAG ROD

The current application claims priority to U.S. provisional application Ser. No. 62/311,017 filed on Mar. 21, 2016.

FIELD OF THE INVENTION

The present invention generally relates to manufacturing flexible flag rods. More specifically, the present invention allows a user to grasp and to maneuver a flexible flag rod.

BACKGROUND OF THE INVENTION

The sport of dance is a very physically demanding sport that requires grace and strength. Dancers who compete and perform at sporting events perform with flag rods. Traditional flag rods are cumbersome and stiff, causing dancer's fatigue and loss of gracefulness.

The present invention serves to preserve the connection between a flag and a rod. The present invention allows a user to directly grip the flag while maintaining the linear structure of the hoist of the flag throughout his or her movement. The present invention provides a durable, lightweight connection between a flexible rod and a flag. More importantly, the flexible flag rod is effectively protected and firmly secured to the flag. The flexible rod of the present invention is protected so that the flexible rod is not damaged if accidentally dropped or if the user accidentally hits a nearby surface of object. The present invention allows a user to customize his or her flag rod to reflect his or her stylistic preferences, dance team spirit, and so on.

DETAIL DESCRIPTIONS OF THE INVENTION

All illustrations of the drawings are for the purpose of describing selected versions of the present invention and are not intended to limit the scope of the present invention.

Figure 2:
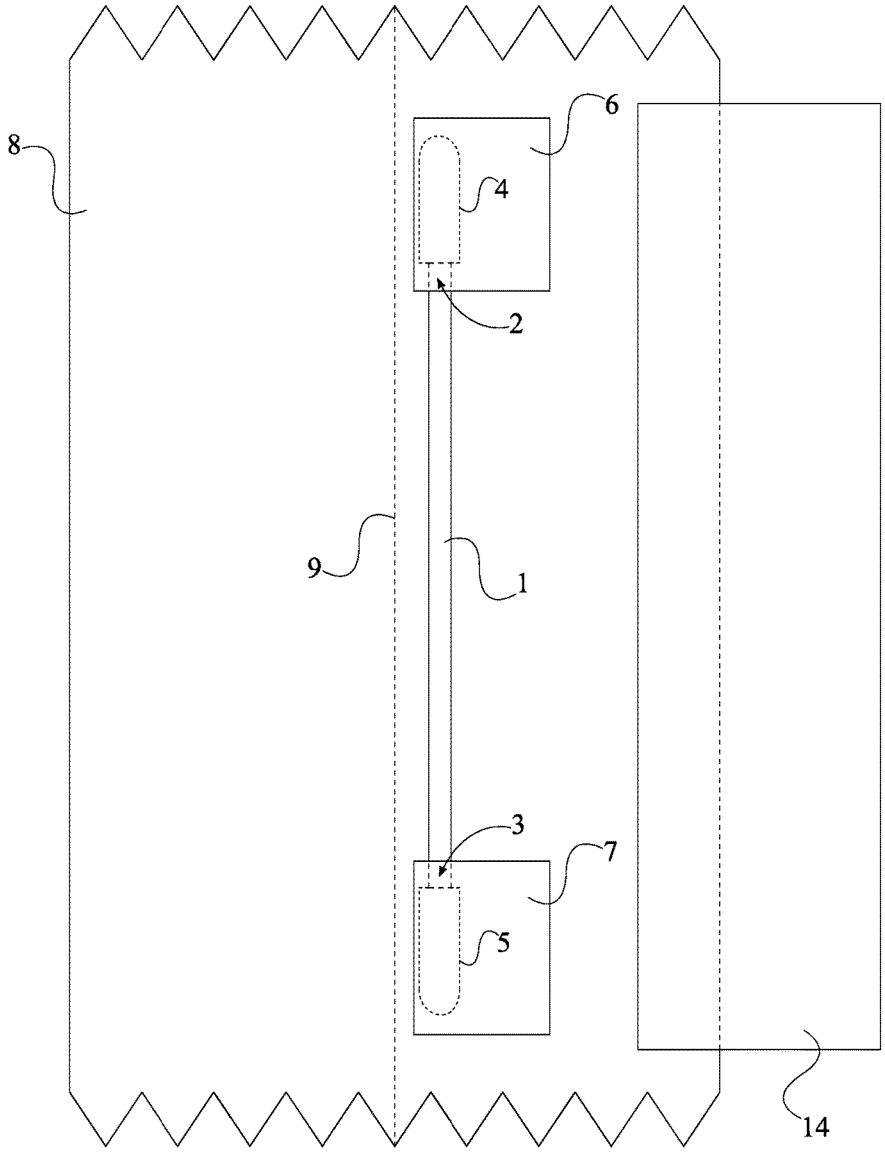
FIG. 2 is a schematic view of the flexible rod, the first endcap, the second endcap, the first tab, the tab, the folded binding, and the sheet of the present invention.

The present invention is a method of manufacturing a flexible flag rod. The present invention is used to produce a flag rod that is structurally reinforced at both distal ends and a flexible. Thus, the physical system used to implement the method of the present invention includes a flexible rod 1, a first endcap 4, a second endcap 5, a first tab 6, a second tab 7 and a folded binding 8 (Step A). The flexible rod 1 upholds the first endcap 4, the second endcap 5, the first tab 6, the second tab 7, and the folded binding 8, as shown in FIG. 2. The flexible rod 1 allows a user to grasp and to maneuver the present invention. The flexible rod 1 can be, but is not limited to, a solid body or fiberglass or a solid body of graphite. The first endcap 4 and the second endcap 5 reinforces the corresponding ends of the flexible rod 1. The first tab 6 and the second tab 7 secures the first endcap 4 and the second endcap 5 to the flexible rod 1, respectively. The folded binding 8 encloses the flexible rod 1, the first endcap 4, the second endcap 5, the first tab 6, and the second tab 7. The folded binding 8 is preferably a strip of ribbon or an elongated flexible sheet 14 with a crease down the middle.

Figure 1:
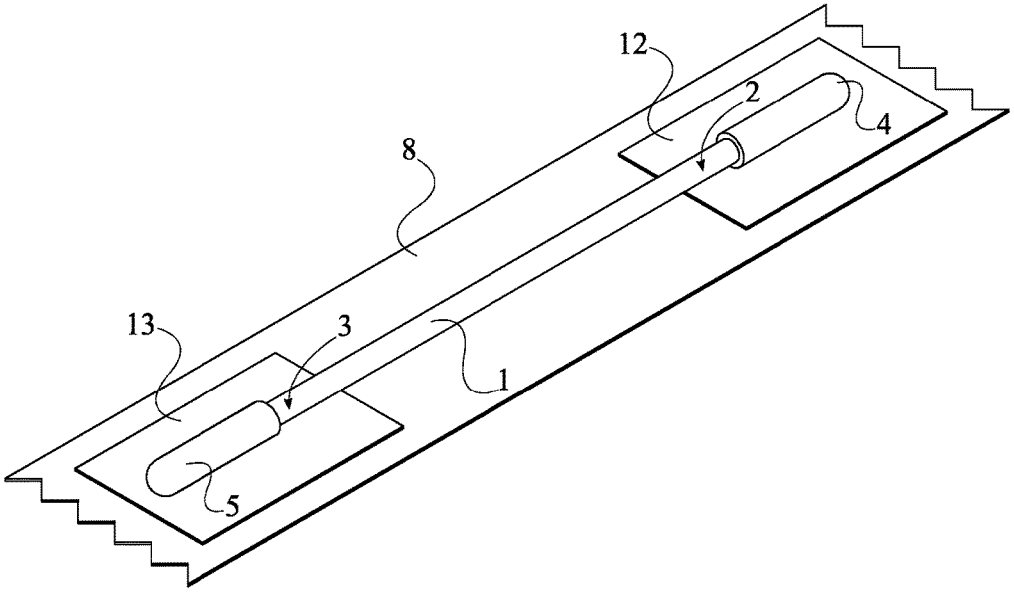
FIG. 1 is a schematic view of the flexible rod, the first endcap, the second endcap, the first reinforcement layer, the second reinforcement layer, and the folded binding of the present invention.
Figure 3:
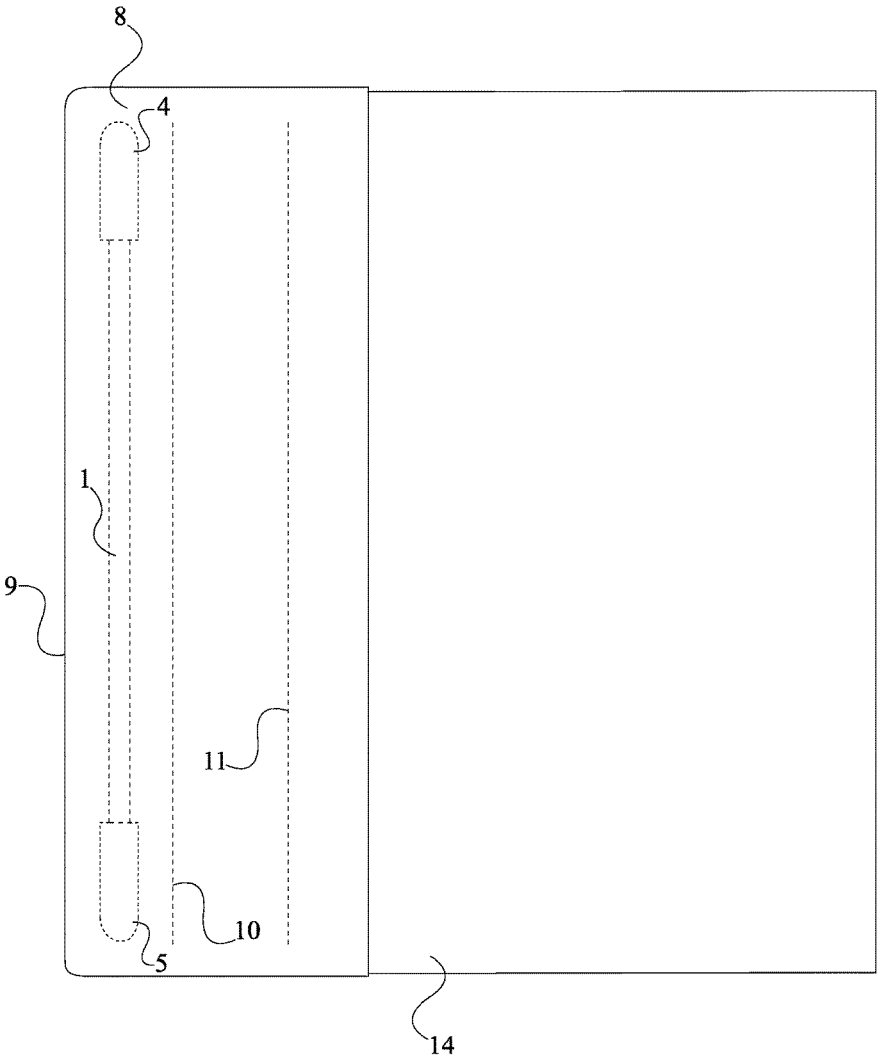
FIG. 3 is a schematic view of the folded binding, the first seam, the second seam, and the sheet of the present invention, wherein the sheet is attached to the folded binding.
Figure 4:
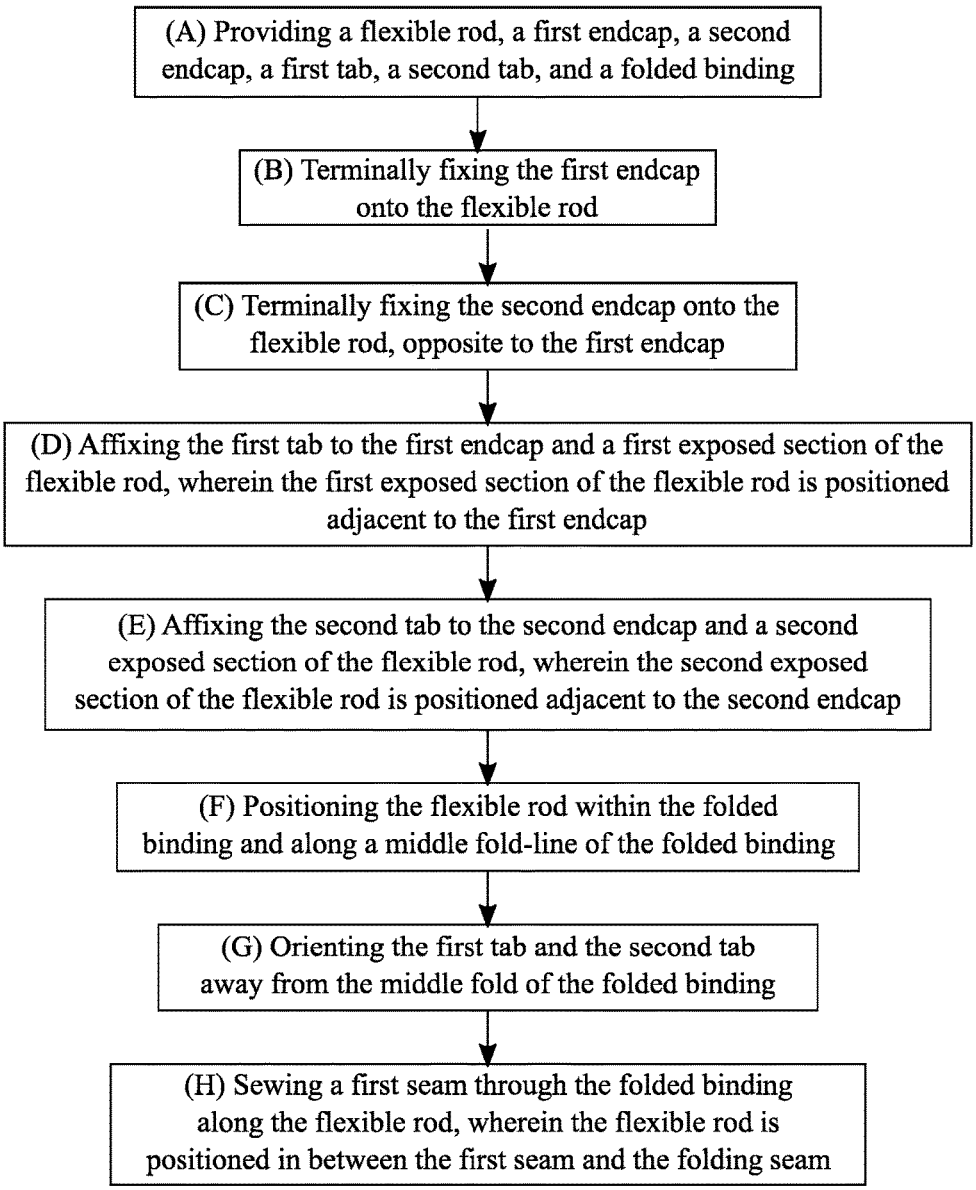
FIG. 4 is a flowchart illustrating the overall process for the present invention.

The overall process for the present invention includes the following steps that are implemented with the flexible rod 1, the first endcap 4, the second endcap 5, the first tab 6, the second tab 7, and the folded binding 8. As shown in FIG. 4, the overall process begins as the first endcap 4 is terminally fixed onto the flexible rod 1 (Step B). Similarly, the second endcap 5 is terminally fixed onto the flexible rod 1, opposite to the first endcap 4 (Step C). This arrangement of the first endcap 4 and the second endcap 5 about the flexible rod 1 is shown in FIG. 1. In the event either of distal ends of the flexible rod 1 falls onto the floor or hits a hard surface, the flexible rod 1 is structurally reinforced with the first tab 6 and the second tab 7. The first tab 6 is affixed to the first endcap 4 and the first exposed section 2 of the flexible rod 1 (Step D), wherein the first exposed section 2 of the flexible rod 1 is positioned to the first endcap 4, so that the first endcap 4 is not easily separated from flexible rod 1. Likewise, the second tab 7 is affixed to the second endcap 5 and the second exposed section 3 of the flexible rod 1 (Step E), wherein the second exposed section 3 of the flexible rod 1 is positioned to the second endcap 5, so that the second endcap 5 is not easily separated from flexible rod 1. In order to completely enclose the flexible rod 1, the flexible rod 1 is positioned within the folded binding 8 and along a middle fold-line 9 of the folded binding 8 (Step F). The first tab 6 and the second tab 7 is oriented away from the middle fold of the folded binding 8 (Step G), as shown in FIG. 3, so that the folded binding 8 completely surrounds both the first tab 6 and the second tab 7. Furthermore, this configuration allows the first tab 6 and the second tab 7 to lay flat within the folded binding 8. Subsequently, a first seam 10 is easily sewn through the folded binding 8 along the flexible rod 1, wherein the flexible rod 1 is positioned in between the first seam 10 and the middle fold-line 9 (Step H). More specifically, the first seam 10 attaches the first tab 6 and the second tab 7 between the folded binding 8. The flexible rod 1 is both protected by the first endcap 4 and the second endcap 5 and effectively surrounded by the folded binding 8.

Figure 5:
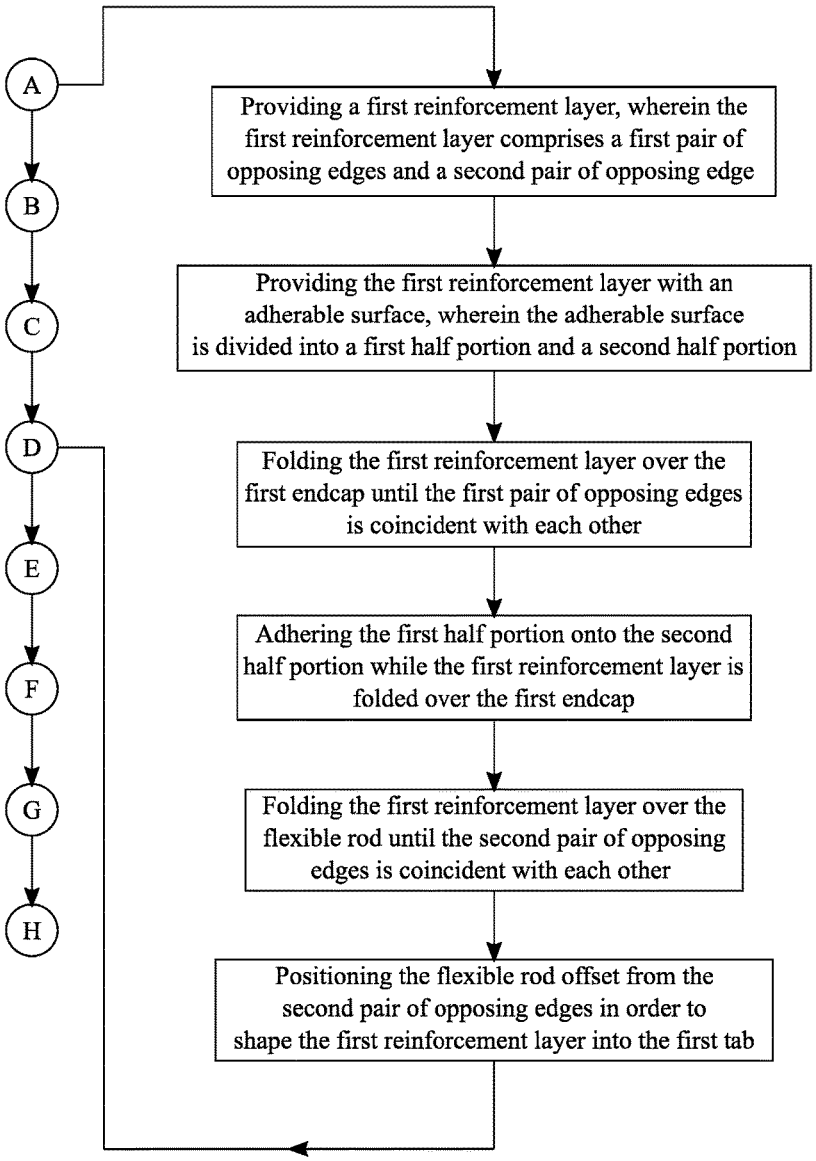
FIG. 5 is a flowchart illustrating the overall process for shaping the first reinforcement layer into the first tab.

In order to properly configure the first tab 6, the present invention is provided with a first reinforcement layer 12, which comprises a first pair of opposing edges and a second pair of opposing edges. The first pair of opposing edges is preferably oriented perpendicular to the second pair of opposing edges. As shown in FIG. 5, the first reinforcement layer 12 is folded over the first endcap 4 until the first pair of opposing edges is coincident with each other. This fold effectively covers the first endcap 4 and the first exposed section 2. The first reinforcement layer 12 is further folded over the flexible rod 1 until the second pair of opposing edges is coincident with each other such that the flexible rod 1 is surrounded by the first reinforcement layer 12. The flexible rod 1 does not extend past the first reinforcement layer 12 as the flexible rod 1 is positioned offset from the second pair of opposing edges in order to shape the first reinforcement layer 12 into the first tab 6. In the preferred embodiment of the present invention, the first reinforcement layer 12 is provided with an adherable surface, wherein the adherable surface is divided into a first half portion and a second half portion. The adherable surface prevents the first endcap 4 and the flexible rod 1 from moving within the first tab 6. The first half portion is adhered onto the second half portion while the first reinforcement layer 12 is folded over the first endcap 4 so that the first endcap 4 remains positioned opposite to the coincidently aligned second pair of opposing edges.

Figure 6:
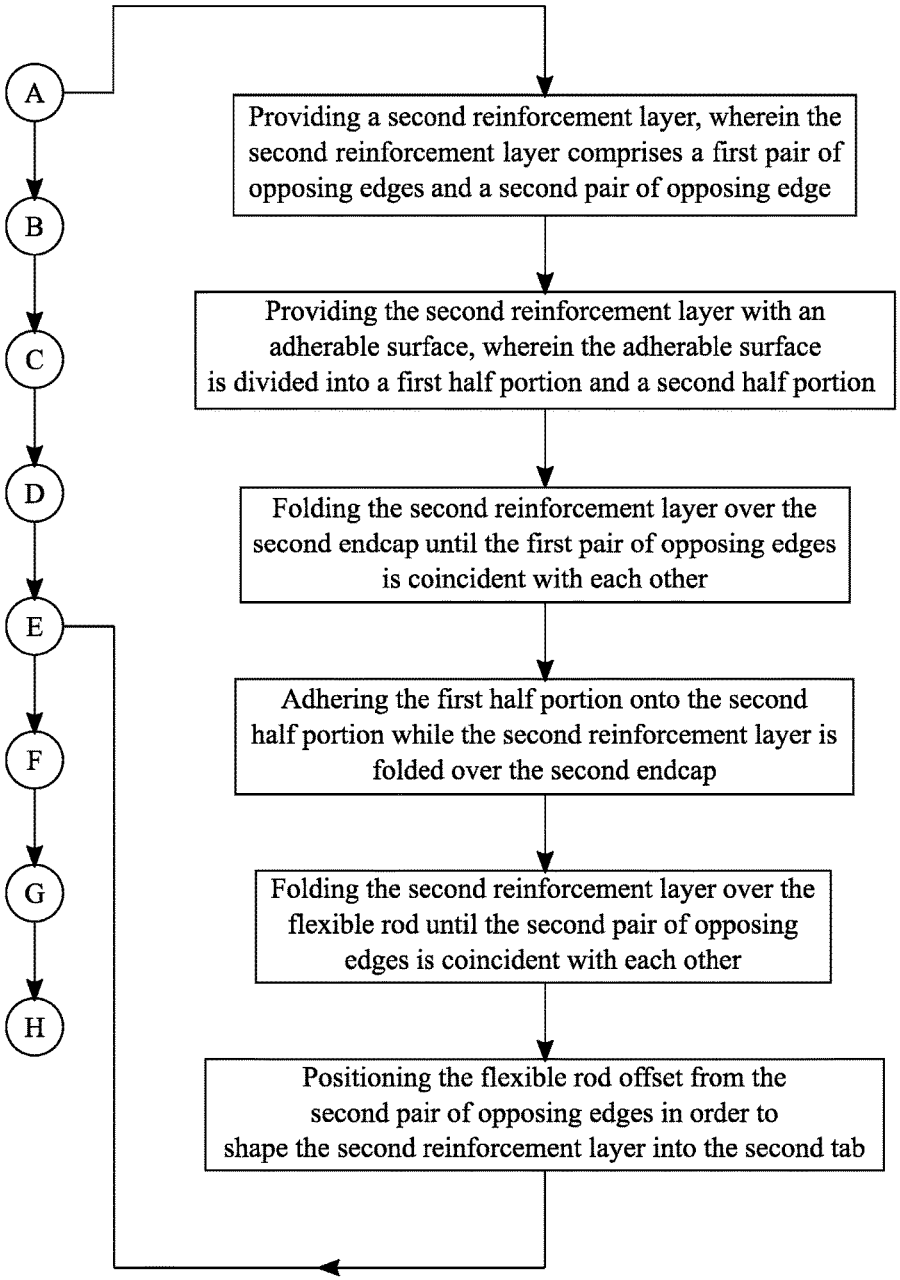
FIG. 6 is a flowchart illustrating the process for shaping the second reinforcement layer into the second tab.

Similar to that of the first tab 6, the present invention is provided with a second reinforcement layer 13, which comprises a first pair of opposing edges and a second pair of opposing edges. The first pair of opposing edges is preferably oriented perpendicular to the second pair of opposing edges. As shown in FIG. 6, the second reinforcement layer 13 is folded over the second endcap 5 until the first pair of opposing edges is coincident with each other. This fold effectively covers the second endcap 5 and the second exposed section 3. The second reinforcement layer 13 is further folded over the flexible rod 1 until the second pair of opposing edges is coincident with each other so that the flexible rod 1 surrounded by the second reinforcement layer 13. The flexible rod 1 does not escape past the second reinforcement layer 13 as the flexible rod 1 is positioned offset from the second pair of opposing edges in order to shape the second reinforcement layer 13 into the second tab 7. In the preferred embodiment of the present invention, the second reinforcement layer 13 is provided with an adherable surface, wherein the adherable surface is divided into a first half portion and a second half portion. The adherable surface prevents the second endcap 5 and the flexible rod 1 from moving within the second tab 7. The first half portion is adhered onto the second half portion while the second reinforcement layer 13 is folded over the second endcap 5 so that the second endcap 5 remains positioned opposite to the coincidently aligned second pair of opposing edges.

Figure 7:
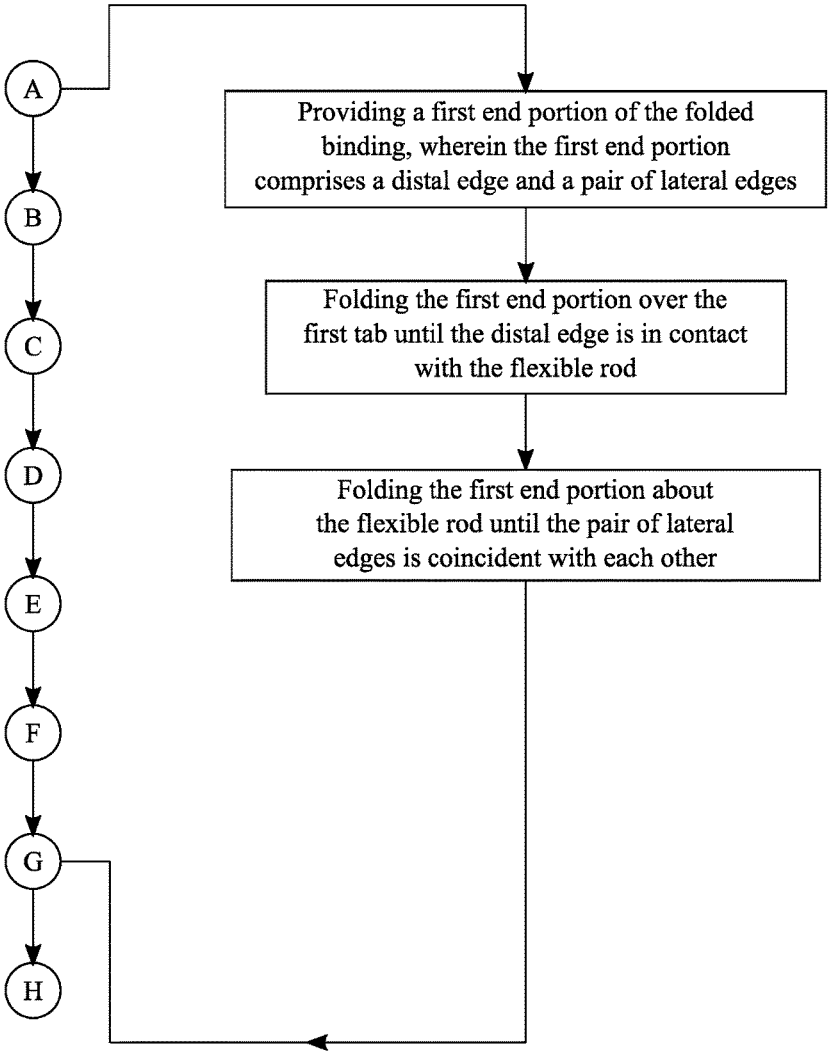
FIG. 7 is a flowchart illustrating the process of folding the first end portion of the folded binding.
Figure 8:
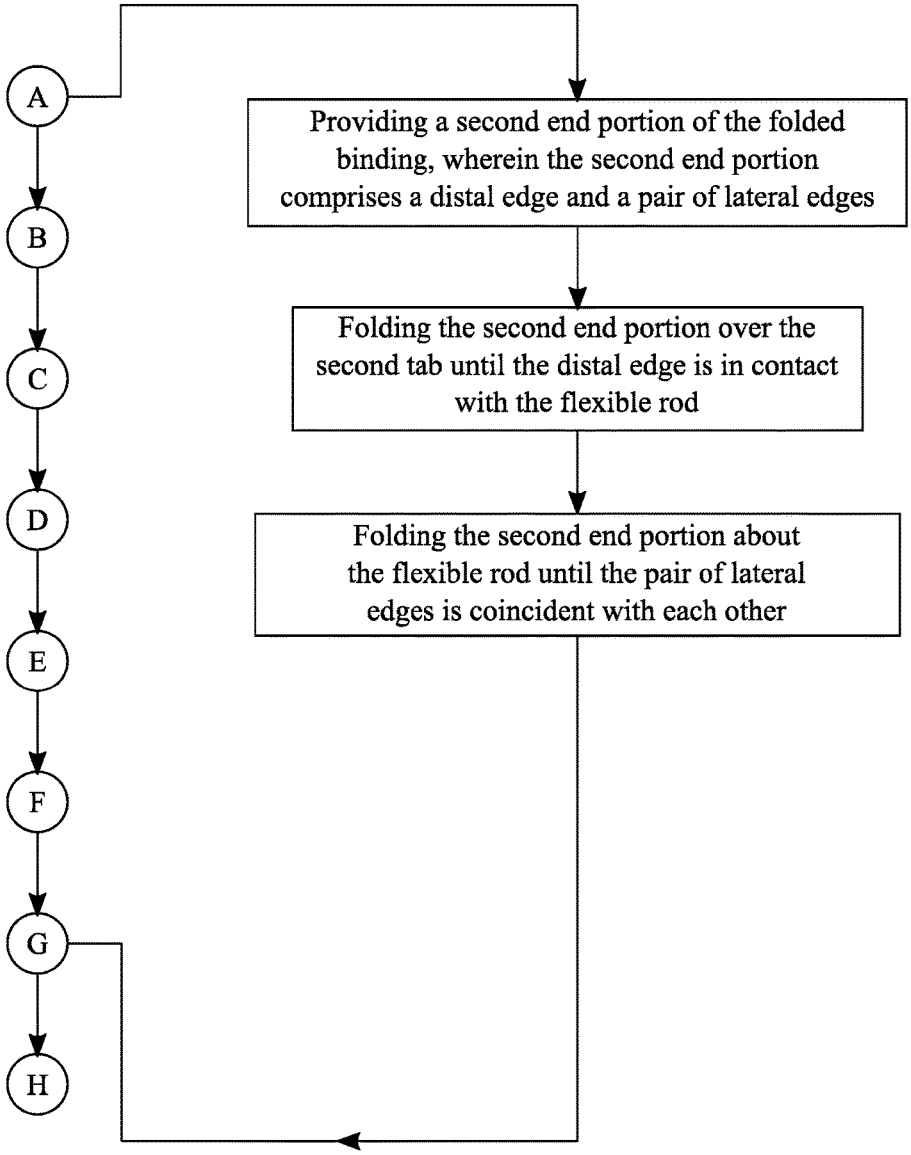
FIG. 8 is a flowchart illustrating the process of folding the second end portion of the folded binding.

In order to secure the folded binding 8 around the first tab 6 and the second tab 7, the folded binding has a first end portion and a second end portion, wherein both the first end portion and the second end portion each comprise a distal edge and a pair of lateral edges. The first end portion covers the first tab 6, and the second end portion covers the second tab 7. The distal edge is preferably oriented perpendicular to the pair of lateral edges. The first tab 6 is covered as the first end portion is folded over the first tab 6 until the distal edge is in contact with the flexible rod 1, as illustrated in FIG. 7. The first tab 6 and the flexible rod 1 are completely housed within the folded binding 8 as the first end portion is folded about the flexible rod 1 until the pair of lateral edges is coincident with each other. Similarly, the second tab 7 is covered as the second end portion is folded over the second tab 7 until the distal edge is in contact with the flexible rod 1, as illustrated in FIG. 8. The second tab 7 and the flexible rod 1 are housed within the folded binding 8 as the second end portion is folded about the flexible rod 1 until the pair of lateral edges is coincident with each other.

Figure 9:
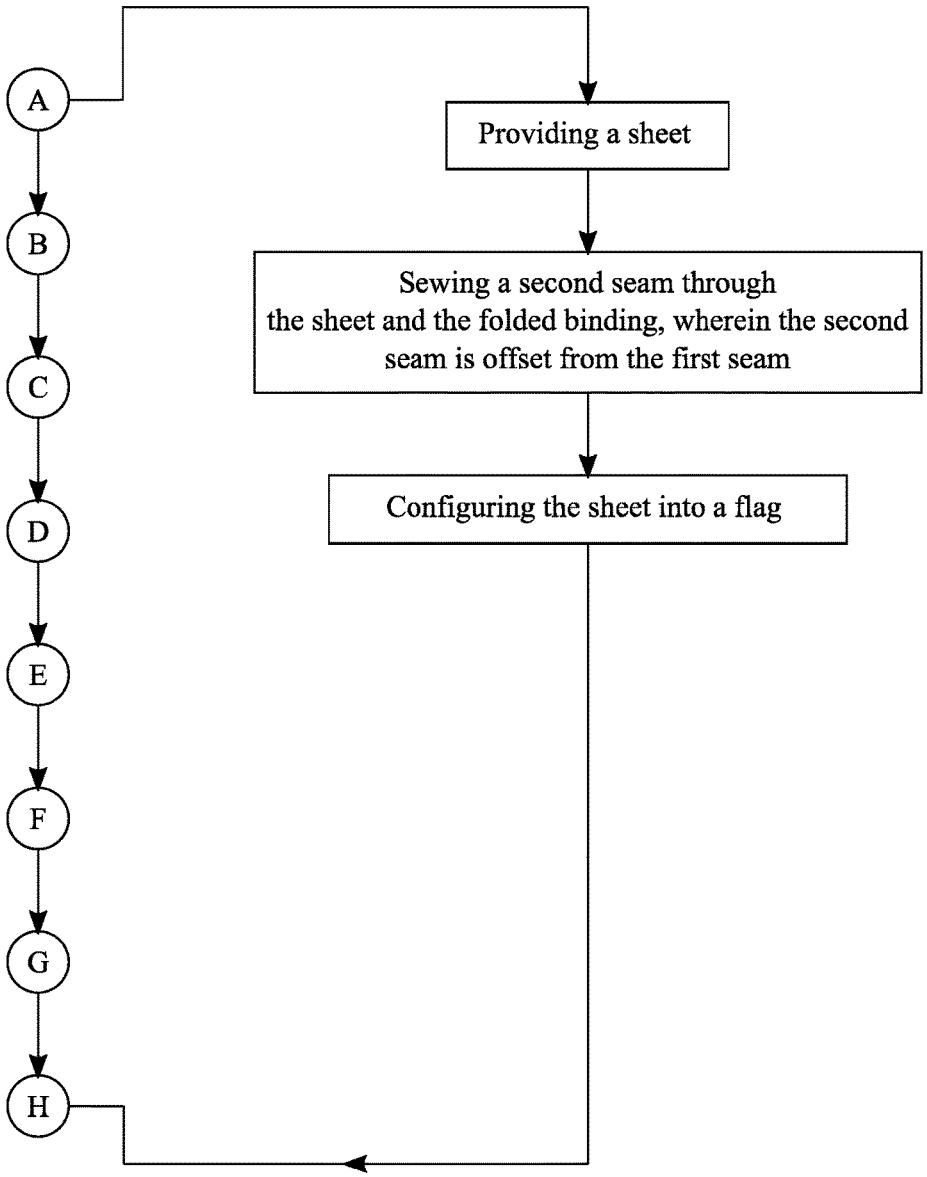
FIG. 9 is a flowchart illustrating the process of sewing the second seam through the sheet and the folded binding.

Furthermore, in the preferred embodiment of the present invention, a sheet 14 is attached to folded binding 8. The sheet 14 is a decorative piece or pieces of fabric that complements the movements of a user. More specifically, the sheet 14 is configured into a flag. As shown in FIG. 9, a second seam 11 is sewn through the sheet 14 and the folded binding 8, wherein the second seam 11 is offset from the first seam 10. The second seam 11 attaches the sheet 14 to the folded binding 8. The user may wave the present invention as he or she dances and moves as the sheet 14 is secured to the folded binding 8.

Although the invention has been explained in relation to its preferred embodiment, it is to be understood that many other possible modifications and variations can be made without departing from the spirit and scope of the invention as hereinafter claimed.

What is claimed is:

1. A method of manufacturing a flexible flag rod, the method comprising steps of:

(A) providing a flexible rod, a first endcap, a second endcap, a first tab, a second tab, and a folded binding;

(B) terminally fixing the first endcap onto the flexible rod;

(C) terminally fixing the second endcap onto the flexible rod, opposite to the first endcap;

(D) affixing the first tab to the first endcap and a first exposed section of the flexible rod, the first exposed section of the flexible rod being positioned adjacent to the first endcap;

(E) affixing the second tab to the second endcap and a second exposed section of the flexible rod, the second exposed section of the flexible rod being positioned adjacent to the second endcap;

(F) positioning the flexible rod within the folded binding and along a middle fold-line of the folded binding;

(G) orienting the first tab and the second tab away from the middle fold of the folded binding; and (H) sewing a first seam through the folded binding along the flexible rod, the flexible rod being positioned in between the first seam and the middle fold-line.

2. The method of manufacturing a flexible flag rod as claimed as claim 1, the method comprising steps of:

providing a first reinforcement layer, the first reinforcement layer comprising a first pair of opposing edges and a second pair of opposing edge;

folding the first reinforcement layer over the first endcap until the first pair of opposing edges is coincident with each other;

folding the first reinforcement layer over the flexible rod until the second pair of opposing edges is coincident with each other; and positioning the flexible rod offset from the second pair of opposing edges in order to shape the first reinforcement layer into the first tab.

3. The method of manufacturing a flexible flag rod as claimed as claim 2, the method comprising steps of:

providing the first reinforcement layer with an adherable surface, the adherable surface being divided into a first half portion and a second half portion; and adhering the first half portion onto the second half portion while the first reinforcement layer is folded over the first endcap.

4. The method of manufacturing a flexible flag rod as claimed as claim 1, the method comprising steps of:

providing a second reinforcement layer, the second reinforcement layer comprising a first pair of opposing edges and a second pair of opposing edge;

folding the second reinforcement layer over the second endcap until the first pair of opposing edges is coincident with each other;

folding the second reinforcement layer over the flexible rod until the second pair of opposing edges is coincident with each other; and positioning the flexible rod offset from the second pair of opposing edges in order to shape the second reinforcement layer into the second tab.

5. The method of manufacturing a flexible flag rod as claimed as claim 4, the method comprising steps of:

providing the second reinforcement layer with an adherable surface, the adherable surface being divided into a first half portion and a second half portion; and adhering the first half portion onto the second half portion while the second reinforcement layer is folded over the second endcap.

6. The method of manufacturing a flexible flag rod as claimed as claim 1, the method comprising steps of:

providing a first end portion of the folded binding, the first end portion comprising a distal edge and a pair of lateral edges;

folding the first end portion over the first tab until the distal edge is in contact with the flexible rod; and folding the first end portion about the flexible rod until the pair of lateral edges is coincident with each other.

7. The method of manufacturing a flexible flag rod as claimed as claim 1, the method comprising steps of:

providing a second end portion of the folded binding, the second end portion comprising a distal edge and a pair of lateral edges;

folding the second end portion over the second tab until the distal edge is in contact with the flexible rod; and folding the second end portion about the flexible rod until the pair of lateral edges is coincident with each other.

8. The method of manufacturing a flexible flag rod as claimed as claim 1, the method comprising step of:

providing a sheet; and sewing a second seam through the sheet and the folded binding, the second seam being offset from the first seam.

9. The method of manufacturing a flexible flag rod as claimed as claim 8, the method comprising step of:

configuring the sheet into a flag.

10. The method of manufacturing a flexible flag rod as claimed as claim 1, wherein the flexible rod is a solid body of fiberglass.

11. The method of manufacturing a flexible flag rod as claimed as claim 1, wherein the flexible rod is a solid body of graphite.

* * * * *